US007941061B2

(12) United States Patent
Kadowaki

(10) Patent No.: US 7,941,061 B2
(45) Date of Patent: May 10, 2011

(54) IMAGE FORMING APPARATUS WITH A PLURALITY OF ANTENNAS

(75) Inventor: Seijiro Kadowaki, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 12/143,456

(22) Filed: Jun. 20, 2008

(65) Prior Publication Data

US 2008/0317479 A1 Dec. 25, 2008

(30) Foreign Application Priority Data

Jun. 20, 2007 (JP) ..... 2007-162654

(51) Int. Cl.
*G03G 15/00* (2006.01)

(52) U.S. Cl. ..... 399/12; 399/111; 399/80

(58) Field of Classification Search ..... 399/9, 12, 399/13

See application file for complete search history.

(56) References Cited

U.S. PATENT DOCUMENTS

| | | | | |
|---|---|---|---|---|
| 6,351,621 | B1 * | 2/2002 | Richards et al. | 399/111 |
| 6,892,033 | B2 * | 5/2005 | Sunada et al. | 399/13 |
| 6,985,119 | B2 * | 1/2006 | Forster et al. | 343/767 |
| 7,190,910 | B2 | 3/2007 | Matsunaga | |
| 7,504,951 | B2 * | 3/2009 | Phipps et al. | 340/572.7 |
| 2005/0111858 | A1 * | 5/2005 | Nakazato | 399/12 |
| 2006/0216046 | A1 | 9/2006 | Hatakeyama | |
| 2008/0138095 | A1 * | 6/2008 | Wegman et al. | 399/12 |

FOREIGN PATENT DOCUMENTS

| | | |
|---|---|---|
| JP | 2001-022230 | 1/2001 |
| JP | 2001-307032 | 11/2001 |
| JP | 2004-045547 | 2/2004 |
| JP | 2005-144845 | 6/2005 |
| JP | 2005-178191 | 7/2005 |
| JP | 2006-208715 | 8/2006 |
| JP | 2006-267528 | 10/2006 |
| JP | 2007-272130 | 10/2007 |

OTHER PUBLICATIONS

Office Action for Japanese Patent Application No. 2007-162654 mailed Jul. 7, 2009.

* cited by examiner

*Primary Examiner* — David M Gray
*Assistant Examiner* — Roy Yi
(74) *Attorney, Agent, or Firm* — Banner & Witcoff, Ltd.

(57) ABSTRACT

An image forming apparatus is provided. The image forming apparatus includes: a body, to which a plurality of image forming cartridges containing developers are attachable; and a communication device which wirelessly communicates with a plurality of non-contact tags provided to the plurality of image forming cartridges, respectively. The communication device includes: a plurality of antennas which are provided correspondingly with the plurality of image forming cartridges; and a switching controller which switches signals from the plurality of antennas.

21 Claims, 13 Drawing Sheets

IMAGE FORMING APPARATUS WITH A PLURALITY OF ANTENNAS

CROSS-REFERENCE TO RELATED APPLICATION

This application claims priority from Japanese Patent Application No. 2007-162654, filed on Jun. 20, 2007, the entire subject matter of which is incorporated herein by reference.

TECHNICAL FIELD

Aspects of the present invention relate to an image forming apparatus such as a printer, a multifunction apparatus, a copier, or a facsimile apparatus.

BACKGROUND

Conventionally, in an image forming apparatus for color printing, for example, image forming cartridges respectively contain toners are detachably attached to the body in order to facilitate maintenance. Recently, non-genuine products of image forming cartridges are marketed. If a non-genuine product is attached to an image forming apparatus, the non-genuine product may not be properly adapted to the image forming apparatus, and the image forming apparatus may break down, and the printed result may be poor. Therefore, an image forming cartridge is provided with a non-contact IC tag storing a unique ID indicating that the cartridge is a genuine product, and other information which is useful for maintenance and the like, such as the remaining amount of the developer contained in the image forming cartridge, the operating time of the image forming cartridge, and the date of manufacture of the image forming cartridge.

A single reader/writer device and a single transmitting and receiving antenna are disposed in the body of the image forming apparatus to perform communication via the antenna with the non-contact IC tags. In the image forming apparatus, the single reader/writer device transmits a request for a response signal via the single antenna to the non-contact IC tags, and thereafter receives a response signal from the non-contact IC tags via the antenna. Then, the apparatus manages the replacement timings and the like of the image forming cartridges on the basis of the received response signals. In such an image forming apparatus, it is not required to dispose plural reader/writer devices in accordance with the number of image forming cartridges, and therefore, inexpensive communication system can be obtained (for example, see JP-A-2001-22230).

In such image forming apparatus, however, the single antenna communicates with plural non-contact IC tags. Therefore, the image forming apparatus is not capable of determining which one of the image forming cartridges a response signal read by the reader/writer device relates to, and hence is not capable of determining whether or not image forming cartridges are correctly attached to the body.

Particularly, in an image forming apparatus, the attaching position of an image forming cartridge is determined depending on the color of the toner, and printing is performed on the assumption that image forming cartridges are attached to correct positions. Therefore, in the case where, for example, an image forming cartridge of a black toner is attached to a position to which an image forming cartridge of a yellow toner is to be attached, the image forming apparatus performs printing assuming that the black toner is a yellow toner. Accordingly, a printed result desired by user cannot be obtained.

However, if plural reader/writer devices are disposed in the body in accordance with the number of image forming cartridges, the image forming apparatus becomes very expensive.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus which is capable of determining that image forming cartridges are correctly attached, and which is inexpensive.

According to an exemplary embodiment of the present invention, there is provided an image forming apparatus including: a body, to which a plurality of image forming cartridges containing developers are attachable; and a communication device which wirelessly communicates with a plurality of non-contact tags provided to the plurality of image forming cartridges, respectively. The communication device includes: a plurality of antennas which are provided correspondingly with the plurality of image forming cartridges; and a switching controller which switches signals from the plurality of antennas.

According to another exemplary embodiment of the present invention, there is provided an image forming apparatus including: a receiving portion which receives a plurality of cartridges containing developers; an image forming portion which forms an image on a sheet with the developers of the plurality of cartridges; a plurality of antennas provided for the plurality of cartridges to receives data from a plurality of non-contact tags attached to the plurality of cartridges, respectively; a selecting switch which selects one of the plurality of antennas; and a tag reader which reads data from the selected one of the plurality of antennas.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of an image forming apparatus according to the present invention will be described with reference to the drawings.

First Exemplary Embodiment

<Schematic Configuration of Printer>

Figure 1:
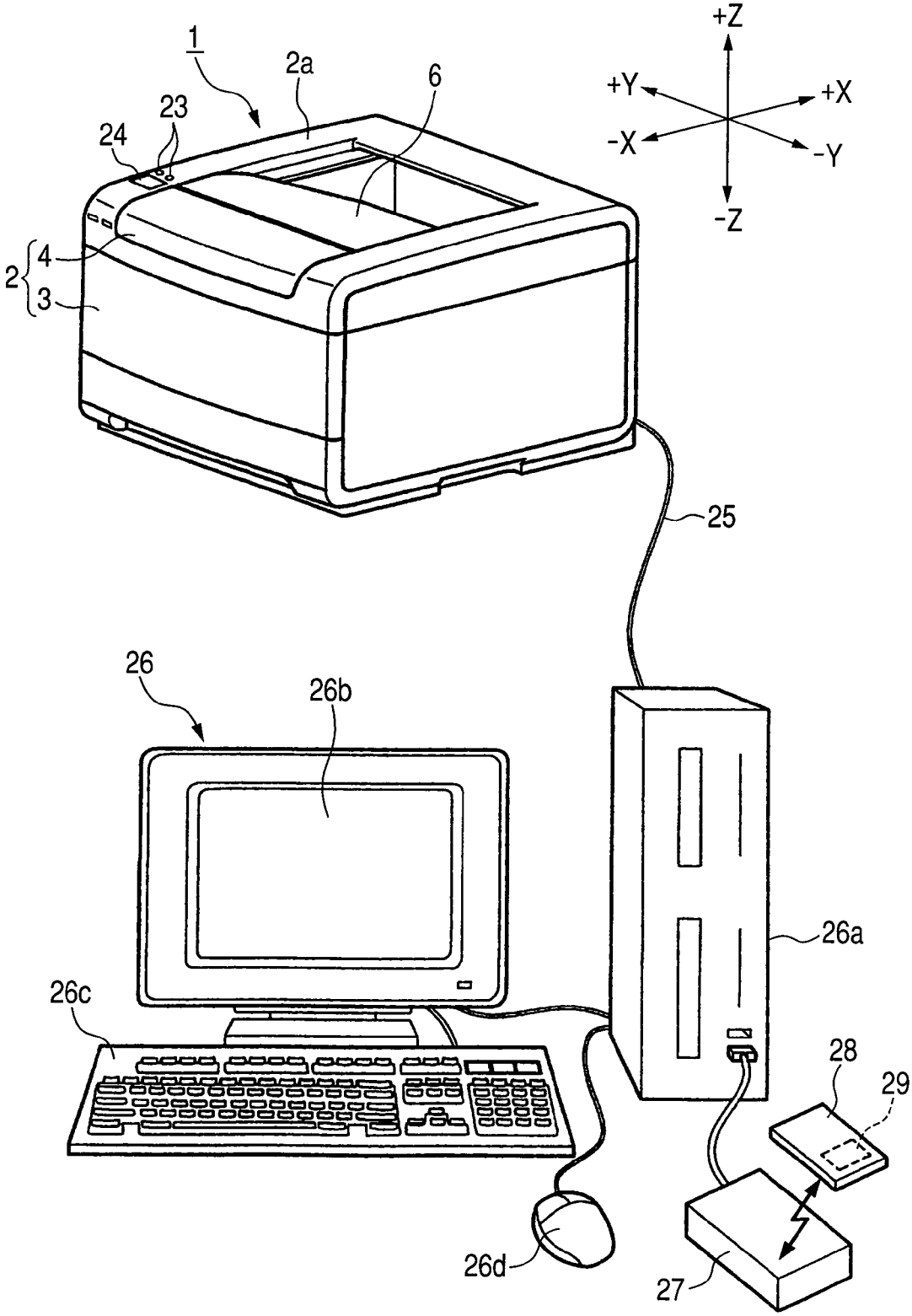
FIG. 1 is an external perspective view of an image forming apparatus (printer) of a first exemplary embodiment of the present invention, and showing a state where the image forming apparatus is connected to a higher-level apparatus.

FIG. 1 is an external perspective view of a printer 1 as an example of an image forming apparatus of a first exemplary embodiment of the present invention, and showing a state where the image forming apparatus is connected to a personal computer 26 as an example of a higher-level apparatus. In the figure, the ±X-directions indicate the anteroposterior direction of the printer 1, the ±Y-directions indicate the lateral direction of the printer 1, and the ±Z-directions indicate the vertical direction of the printer 1.

The printer 1 has box-like outer appearance formed by a resin-made body 2. In the body 2, a cover portion 4 is pivotably held to a rear portion of a body portion 3. In an upper portion 2*a* of the body 2, an operating portion 23 for operating the printer 1, and a displaying portion 24 which displays data are disposed in the left side (the +Y side) of the cover portion 4.

The printer 1 is connected to the personal computer 26 which is an example of a higher-level apparatus through a cable 25. The printer 1 may be connected to the personal computer 26 in a one-to-one relationship, or may be connected to the personal computer 26 via a network or the like. In the personal computer 26, a display device 26*b*, a keyboard 26*c*, and a mouse 26*d* are connected to a control main unit 26*a* to input and output data. Also a reader/writer device 27, which is used for reading and writing data from and into a non-contact IC tag 29 attached to an authentication card 28 such as an employee ID card, is connected to the control main unit 26*a*.

<Internal Configuration of Printer>

Figure 2:
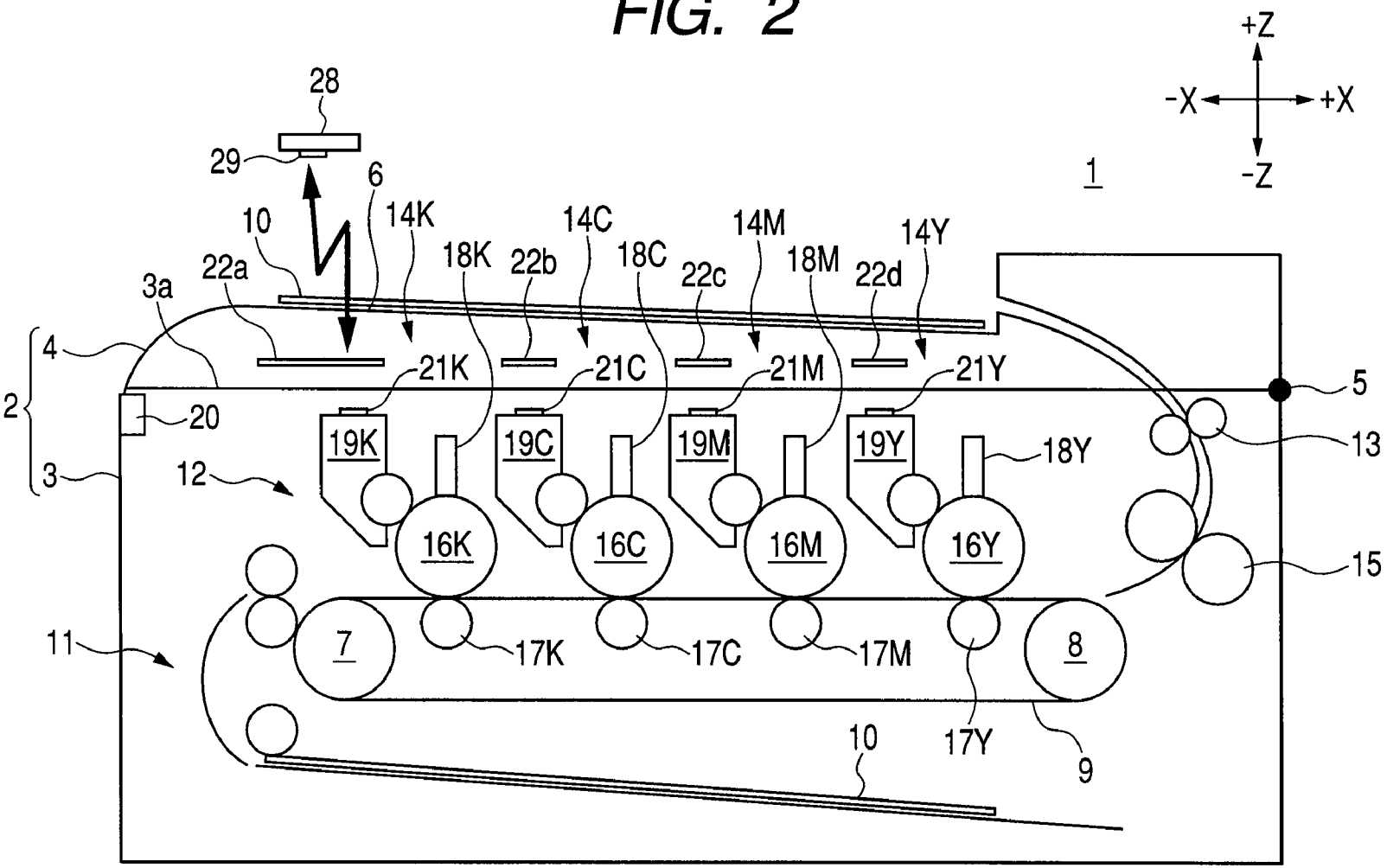
FIG. 2 is a schematic diagram of the internal configuration of the printer shown in FIG. 1.

FIG. 2 is a schematic diagram of the internal configuration of the printer 1 shown in FIG. 1. Plural image forming cartridges 19K, 19C, 19M, 19Y, which contain toners which are an example of developer, are attached to the body 2 of the printer 1. The body 2 comprises a body portion 3 including an opening 3*a* which opens upwardly; and a cover portion 4 which is pivotably attached to the body portion 3 through a hinge 5 so as to cover the opening 3*a*. Both the body portion 3 and the cover portion 4 are made of resin. A discharge tray 6 is formed on the outer face of the cover portion 4.

In the printer 1, a driving roller 7 and a driven roller 8 are horizontally placed in a middle portion of the body 2 (the body portion 3), and a conveyor belt 9 is wound around the rollers. The body 2 houses sheets 10 in a stacked state, below the conveyor belt 9. In the circumference of the conveyor belt 9, a sheet feeding portion 11, an image forming portion 12, and a sheet discharging portion 13 are arranged. Each of the sheets 10 is picked up by the sheet feeding portion 11 to be fed to the image forming portion 12, an image forming process is performed on the sheet in the image forming portion 12, and then the sheet is discharged through the sheet discharging portion 13 to the discharge tray 6.

In the image forming portion 12, first to fourth image forming units 14K, 14C, 14M, 14Y respectively for black (K), cyan (C), magenta (M), and yellow (Y) are aligned in the direction of conveying the sheet 10. In other words, in the image forming portion 12, the first to fourth image forming units 14K, 14C, 14M, 14Y are aligned in the horizontal anteroposterior direction (from the −X direction to the +X direction) of the body 2. A fixing portion 15 which thermally fixes color toners that are transferred to the sheet 10 by the image forming units 14K, 14C, 14M, 14Y is disposed on the downstream side of the fourth image forming unit 14Y.

Hereinafter, the configurations of the first to fourth image forming units 14K, 14C, 14M, 14Y will be described. Since the first to fourth image forming units 14K, 14C, 14M, 14Y have same configuration, only the configuration of the first image forming unit 14K will be described, and the description of the configurations of the second to fourth image forming units 14C, 14K, 14Y will be omitted.

In the first image forming unit 14K, a photosensitive drum 16K and a transfer roller 17K are rotatably disposed across the conveyor belt 9. An exposing device 18K and an image forming cartridge 19K are arranged in the rotation direction (a counterclockwise direction in the figure) of the photosensitive drum 16K. The image forming cartridge 19K contains a toner of black (K). In order to facilitate replacement of a toner of black (K), the image forming cartridge 19K is detachably attached to a receiving portion of the body 2.

In the first image forming unit 14K, the toner is supplied from the image forming cartridge 19K to the surface of the photosensitive drum 16K on which an electrostatic image is formed by the exposing device 18K, to visualize the electrostatic image, and the toner is transferred to the sheet 10 between the photosensitive drum 16K and the transfer roller 17K.

In the thus configured printer 1, the image forming cartridges 19K, 19C, 19M, 19Y are attached to the body 2 in the same manner. The image forming cartridges 19K, 19C, 19M, 19Y are aligned in the body portion 3 in the horizontal anteroposterior direction (from the −X direction to the +X direction), and the upper portions of the cartridges are covered by the cover portion 4. When the cover portion 4 of the body 2 is set to the opened state, therefore, the image forming cartridges 19K, 19C, 19M, 19Y are opened to the outside of the body 2.

An open/close sensor 20 which is an example of an open/close detecting unit which detects the opened/closed state of the cover portion 4. It is matter of course that the open/close sensor 20 may be configured any means such as a limit switch, a magnetic switch, or a piezoelectric sensor as far as it can detect the opening/closing state of the cover portion 4.

Non-contact IC tags 21K, 21C, 21M, 21Y are attached to the upper faces of the image forming cartridges 19K, 19C, 19M, 19Y, respectively.

Each of the non-contact IC tags 21K, 21C, 21M, 21Y stores, in a read-only manner, a unique ID for identifying the corresponding one of the image forming cartridges 19K, 19C, 19M, 19Y; and other information specific to the image forming cartridge 19K, 19C, 19M, or 19Y, such as the color of the toner contained in the cartridge, and the date of manufacture. Furthermore, each of the non-contact IC tags 21K, 21C, 21M, 21Y stores, in a readable and writable manner, information which is useful for maintenance and the like, such as the operating time of the image forming cartridge 19K, 19C, 19M, or 19Y, and the remaining amount of the toner.

In the body 2, first to fourth antennas 22*a*, 22*b*, 22*c*, 22*d* are placed correspondingly with the image forming cartridges 19K, 19C, 19M, 19Y. Each of the first to fourth antennas 22*a*, 22*b*, 22*c*, 22*d* is configured by a planar loop coil antenna, and placed inside the upper portion 2*a* of the body 2, or in other words inside the cover portion 4 or the discharge tray 6 so that the planar portion of the antenna extends parallel to the upper portion. The first to fourth antennas 22*a*, 22*b*, 22*c*, 22*d* are capable of flux-coupling to the radio waves emitted from the non-contact IC tags 21K, 21C, 21M, 21Y.

Figure 3:
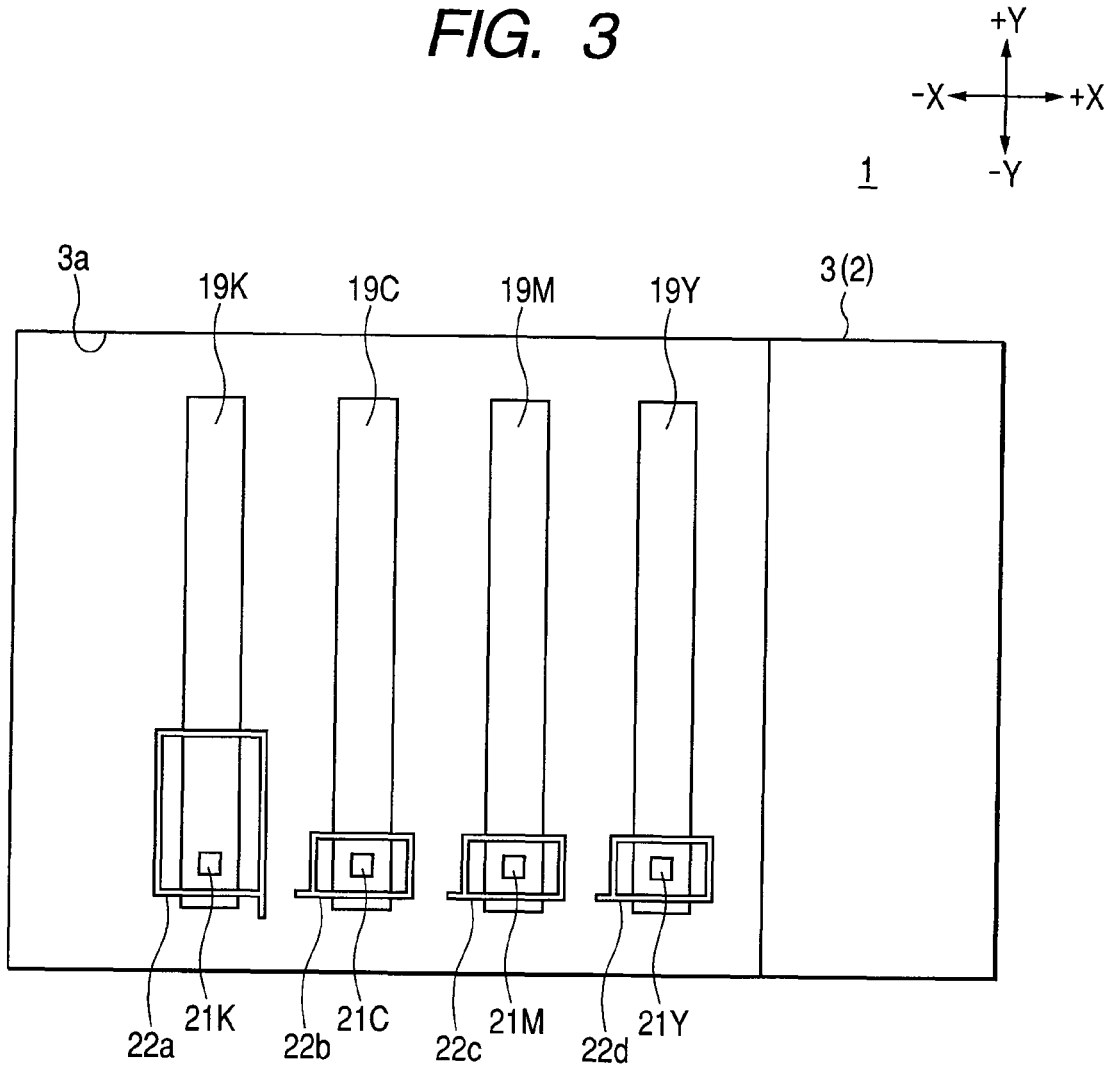
FIG. 3 is a diagram of the printer shown in FIG. 2 as viewed from an upper side, and showing positional relationships among non-contact IC tags and antennas.

FIG. 3 is a diagram of the printer 1 shown in FIG. 2 as viewed from the upper side, and showing positional relationships among the non-contact IC tags 21K, 21C, 21M, 21Y and the first to fourth antennas 22*a*, 22*b*, 22*c*, 22*d*.

The first to fourth antennas 22*a*, 22*b*, 22*c*, 22*d* are larger than the non-contact IC tags 21K, 21C, 21M, 21Y, and cover antenna (readable) regions of the non-contact IC tags 21K, 21C, 21M, 21Y, respectively.

Particularly, the first antenna 22*a*, which is placed in the foremost side (−X side) of the body 2, is set so that the plane area of the coil antenna is larger than the plane areas of the coil antennas of the other or second to fourth antennas 22*b*, 22*c*, 22*d*. In the first exemplary embodiment, the first antenna 22*a* is set so that the plane area of the coil antenna is larger than the authentication card 28 such as an employee. ID card (see FIG. 2), thereby increasing the readable region of the authentication card 28.

<Electric Block Configuration of Printer>

Figure 4:
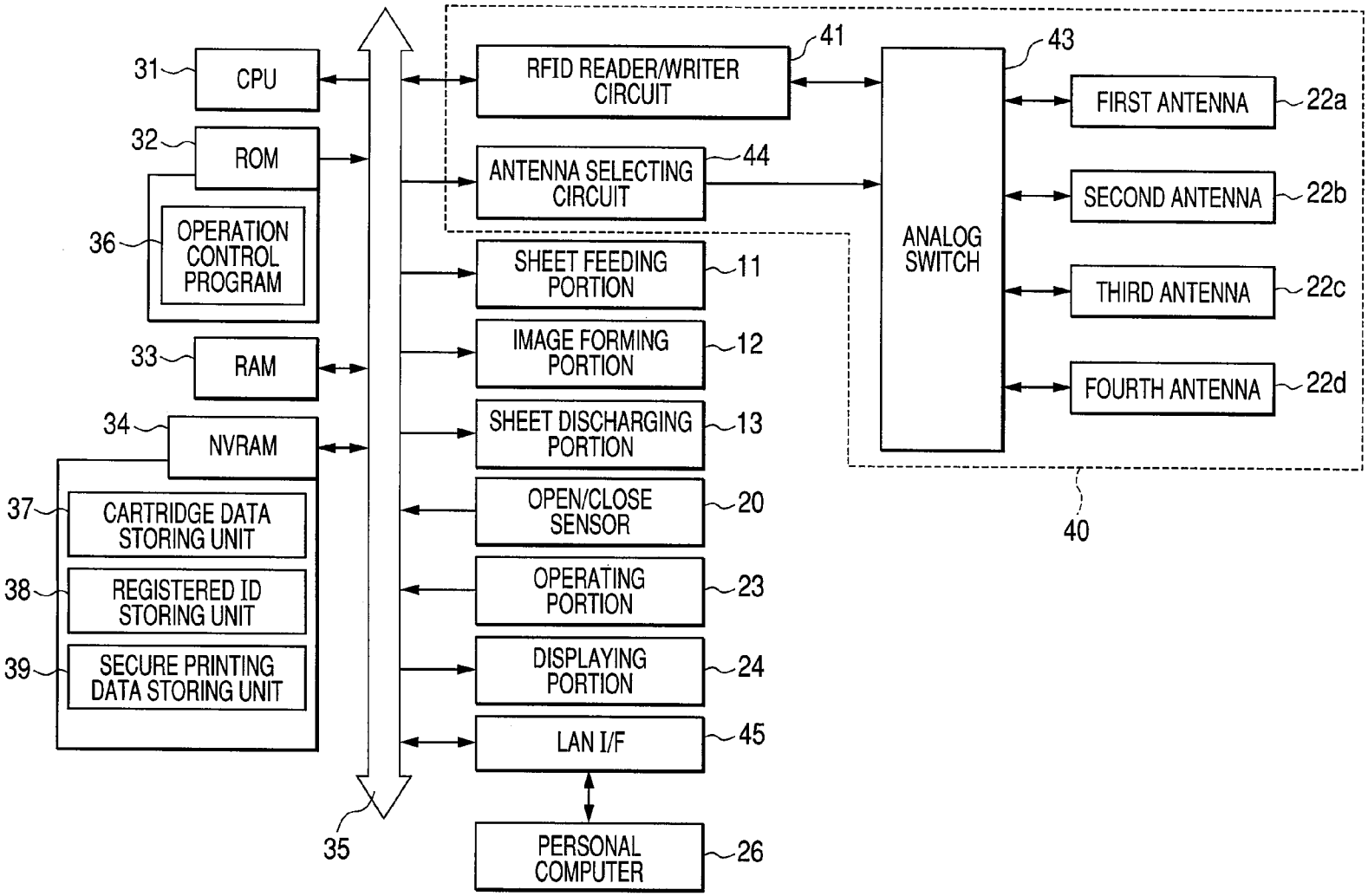
FIG. 4 is a control block diagram of the printer shown in FIG. 2.

FIG. 4 is a control block diagram of the printer 1 shown in FIG. 2. In the printer 1, memories such as a ROM 32, a RAM 33, and an NVRAM 34 are electrically connected to a CPU 31 through a bus 35. The CPU 31 is connected, through the bus 35, to the sheet feeding portion 11, the image forming portion 12, the sheet discharging portion 13, the open/close sensor 20, the operating portion 23, and the displaying portion 24, and controls the operation of the printer 1 and the printing process. The CPU 31 is connected to the personal computer 26 through a LAN interface (hereinafter, referred to as "LAN I/F") 45 to control transmission/reception of data.

The ROM 32 stores an operation control program 36 for controlling the 20 operation of the printer 1. The operation control program 36 causes the printer 1 to execute a printing function, and other functions of reading data from the non-contact IC tags 21K, 21C, 21M, 21Y, enabling the operation of the operating portion 23 by personal authentication, and performing a secure printing process.

Storage areas for a cartridge data storing unit 37, a registered ID storing unit 38, and a secure printing data storing unit 39 are included in the NVRAM 34.

The cartridge data storing unit 37 stores data which are read from the non-contact IC tags 21K, 21C, 21M, 21Y by a communicating device 40, so as to be identifiable and associated with the first to fourth antenna 22*a*, 22*b*, 22*c*, or 22*d* through which the data are read. The registered ID storing unit 38 stores an authentication ID of a user who is authorized to use the printer 1, as a registered ID. The secure printing data storing unit 39 accumulatively stores print data which are set as a secure print job.

The CPU 31 is further connected to the communicating device 40 through the bus 35. The communicating device 40 transmits and receives data in a non-contact manner to and from the non-contact IC tags 21K, 21C, 21M, 21Y. In other words, the communication device 40 wirelessly communicates with the non-contact IC tags 21K, 21C, 21M, 21Y. The communicating device 40 includes an RFID reader/writer circuit 41, an analog switch 43 which is an example of a switching controller, an antenna selecting circuit 44, and the first to fourth antennas 22*a*, 22*b*, 22*c*, 22*d*.

The RFID reader/writer circuit 41 controls an electric signal when the first to fourth antennas 22*a*, 22*b*, 22*c*, 22*d* communicate with the non-contact IC tags 21K, 21C, 21M, 21Y attached to the image forming cartridges 19K, 19C, 19M, 19Y, and the-non-contact IC tag 29 of the authentication card 28, and controls reading and writing of data from and into the non-contact IC tags 21K, 21C, 21M, 21Y attached to the image forming cartridges 19K, 19C, 19M, 19Y, and the non-contact IC tag 29 of the authentication card 28.

The analog switch 43 switches signals from the first to fourth antennas 22*a*, 22*b*, 22*c*, 22*d*. In the analog switch 43, a signal from the RFID reader/writer circuit 41 is switched to the first to fourth antennas 22*a*, 22*b*, 22*c*, 22*d* to individually transmit and receive data to and from the non-contact IC tags 21K, 21C, 21M, 21Y.

The antenna selecting circuit 44 instructs the analog switch 43 to select one of the antennas, to control the switching operation of the analog switch 43. The antenna selecting circuit 44 may be incorporated in the RFID reader/writer circuit 41.

<Description of Operation of Operation Control Program>

Figure 5:
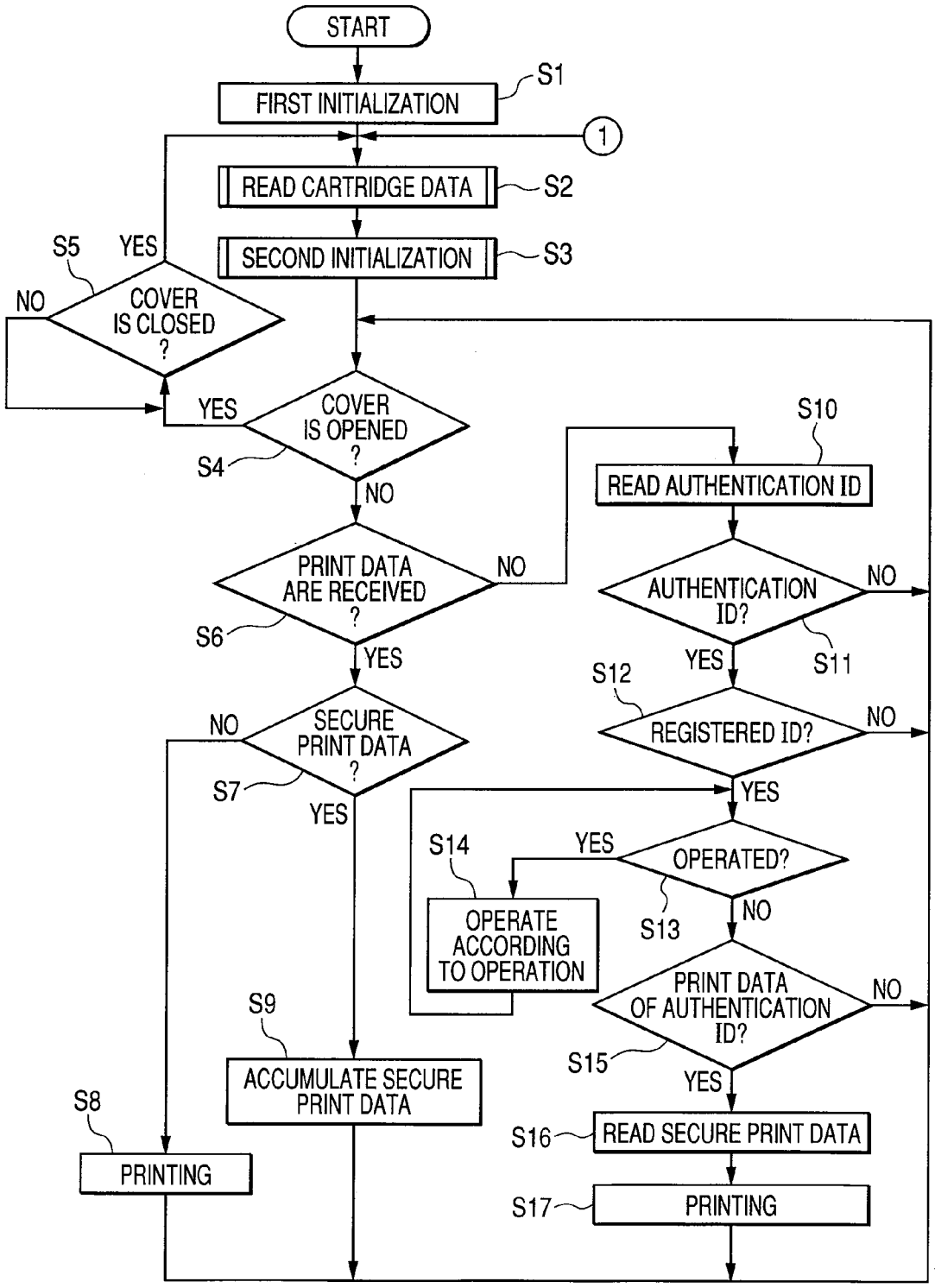
FIG. 5 is a main flowchart of an operation control program shown in FIG. 4.

Next, the operation of the operation control program 36 will be described. FIG. 5 is a main flowchart of the operation control program 36 shown in FIG. 4. When the printer 1 is powered on, the CPU 31 reads the operation control program 36 from the ROM 32, and copies it into the RAM 33. During a time period from power on of the printer 1 to power off, the CPU 31 executes the operation control program 36 at predetermined time intervals to perform the following processes.

If the printer 1 is powered on, the CPU 31 performs initialization. Specifically, the CPU 31 performs first initialization in step 1 (hereinafter, referred to as "S1"). In the first initialization, for example, initialization of various registers, a warming-up operation, and the like are performed. Then, the CPU 31 performs in S2 a process of reading cartridge data. Namely, the CPU 31 causes the communicating device 40 to read data of the non-contact IC tags 21K, 21C, 21M, 21Y attached to the image forming cartridges 19K, 19C, 19M, 19Y, and stores the data into the cartridge data storing unit 37.

Figure 6:
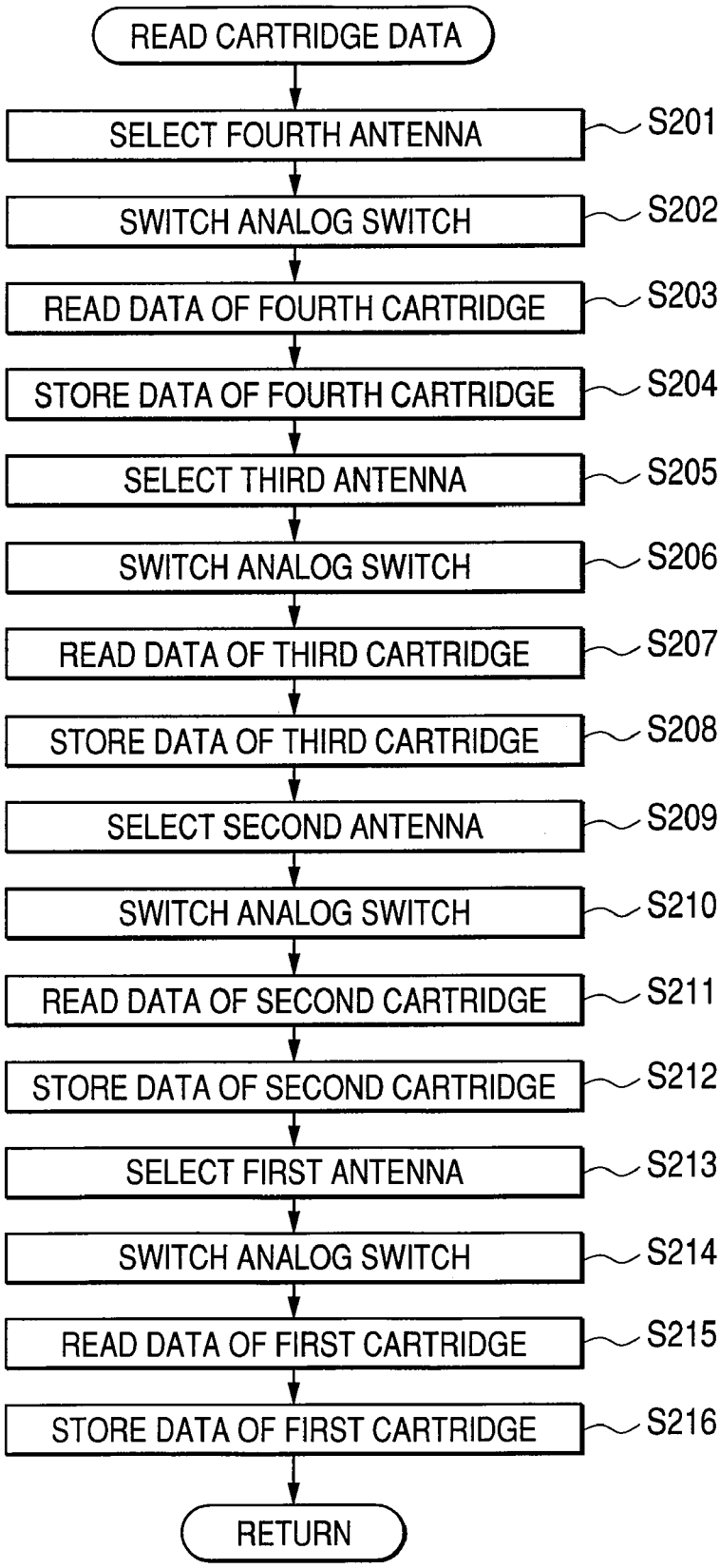
FIG. 6 is a sub-flowchart of a cartridge data reading process shown in FIG. 5.

FIG. 6 is a sub-flowchart of the cartridge data reading process (S2) shown in FIG. 5.

Specifically, the CPU 31 controls in S201 the antenna selecting circuit 44 to instruct the analog switch 43 to select the fourth antenna 22*d*, and in S202 switches the analog switch 43 so that communication is performed and data are obtained with using the fourth antenna 22*d*.

In S203, the CPU 31 reads data of the non-contact IC tag 21Y via the fourth antenna 22*d*, the analog switch 43, and the reader/writer circuit 41.

In S204, the CPU 31 converts the read data to a processable signal, and stores the data into the cartridge data storing unit 37 while associated with the fourth antenna 22*d*. As a result, the printer 1 can identify the data stored in the cartridge data storing unit 37 as those which are received via the fourth antenna 22*d*.

In a similar manner as S201 to S204 above, the CPU 31 obtains data of the non-contact IC tags 21M, 21C, 21K of the image forming cartridges 19M, 19C, 19K, and stores in an identifiable manner into the cartridge data storing unit 37 while associated with the third to first antennas 22*c*, 22*b*, 22*a* (S205 to S216). Thereafter, the control returns to S2 of FIG. 5.

Figure 7:
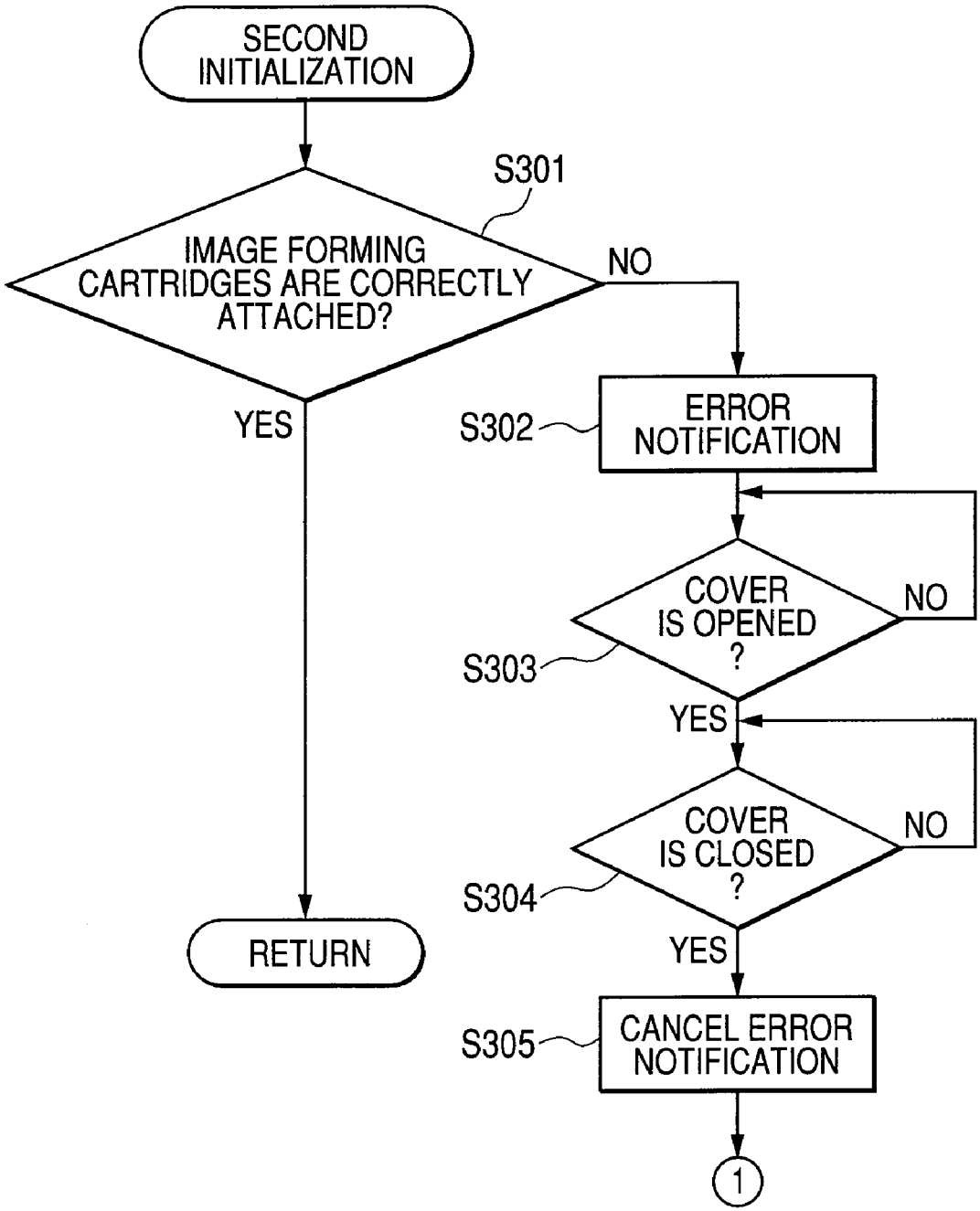
FIG. 7 is a sub-flowchart of a second initialization process shown in FIG. 5.

In S3 of FIG. 5, the printer 1 performs second initialization. FIG. 7 is a sub-flowchart of the second initialization process (S3) shown in FIG. 5. In the second initialization, it is checked whether or not the image forming cartridges 19K, 19C, 19M, 19Y are correctly attached to the body 2. If not correctly attached, error notification is performed to request the user to again attach the image forming cartridges 19K, 19C, 19M, 19Y to the body 2 in the correct manner.

Specifically, it is determined in S301 whether or not the image forming cartridges 19K, 19C, 19M, 19Y are correctly attached to the body 2. For example, the determination is performed based on whether or not color data included in the data which are stored while associated with the first to fourth antennas 22*a*, 22*b*, 22*c*, 22*d* coincide with those which are to be read via the first to fourth antennas 22*a*, 22*b*, 22*c*, 22*d* when the image forming cartridges 19K, 19C, 19M, 19Y are correctly attached. Furthermore, for example, the determination is performed based on whether or not the operating time, the toner remaining amount, and the like included in the data which are stored while associated with the first to fourth antennas 22*a*, 22*b*, 22*c*, 22*d* coincide with the immediately previous values.

If it is determined that the image forming cartridges 19K, 19C, 19M, 19Y are correctly attached to the body 2 (S301: YES), the control returns to S3 without performing a further process.

By contrast, if it is determined that the image forming cartridges 19K, 19C, 19K, 19Y are not correctly attached to the body 2 (S301: NO), error notification is performed in S302. Based on the detection signal of the open/close sensor 20, thereafter, it is determined in S303 whether or not the cover portion 4 is opened. If the cover portion 4 is not opened (S303: NO), this means that the error cancellation is not performed by conducting replacement of the cartridges, and therefore the control waits without performing a further process.

By contrast, if the cover portion. 4 is opened (S303: YES), it is determined in S304 whether or not the cover portion 4 is closed, based on the detection signal of the open/close sensor 20. If the cover portion 4 is not closed (S304: NO), this means that the cartridge replacement work is being performed, and therefore the control waits without performing a further process.

If the cover portion 4 is closed (S304: YES), this means that the cartridge replacement work is completed, and therefore the error notification which is displayed on the displaying portion 24 is cancelled. Thereafter, the control returns to S2 of FIG. 5.

In this way, the attachment states of the image forming cartridges 19K, 19C, 19M, 19Y are checked (S3 of FIG. 5). Based on the detection signal of the open/close sensor 20, thereafter, it is determined in S4 of FIG. 5 whether or not the cover portion 4 is opened. If it is determined that the cover portion 4 is opened (S4: YES), it is determined in S5 whether or not the cover portion 4 is closed. The control waits until the cover portion 4 is closed (S5: NO). If it is determined that the cover portion 4 is closed (S5: YES), the control returns to S2.

By contrast, if it is determined that the cover portion 4 is not opened (S4: NO), it is determined in S6 whether or not print data are received. If print data are received (S6: YES), the received print data are analyzed, and it is determined in S7 whether or not the data are secure print data which are set as a secure print job. If it is determined that the data are not secure print data (S7: NO), printing is executed in S8.

If it is determined that the data are secure print data (S7: YES), the secure print data are accumulatively stored in S9 into the secure printing data storing unit 39, and thereafter the control returns to S4. As a result, the secure print data are stored in the printer 1 until the user inputs secure print instructions to the operating portion 23.

By contrast, if it is determined that print data are not received (S6: NO), the CPU 31 reads an authentication ID in S10. Specifically, at this timing, the first antenna 22*a* has been selected (see S213 of FIG. 6), and hence the CPU 31 transmits a signal from the first antenna 22*a* via the RFID reader/writer circuit 41 and the analog switch 43. Since the body 2 is made of resin, the transmitted signal is sent also to the outside of the body 2.

In the case where the user does not hold the authentication card 28 over the printer 1, no reflection (response) to the transmitted signal exists, and therefore it is determined that no authentication ID exists (S11: NO). Then, the control returns to S4.

When the user holds the authentication card 28 over the printer 1, particularly the vicinity of the installation position of the first antenna 22*a*, the CPU 31 reads the authentication ID from the non-contact IC tag 29 of the authentication card 28 via the first antenna 22*a* and the RFID reader/writer circuit 41 through the body 2 which is made of resin (S11: YES). Then, the CPU 31 checks in S12 the read authentication ID with the registered ID of the registered ID storing unit 38. If the read authentication ID does not match the registered ID (S12: NO), this means that the present user is not authorized to use the printer 1, and therefore the CPU 31 returns to S4 without performing printing, change of the settings, and the like.

By contrast, if the read authentication ID matches the registered ID (S12: YES), it is determined in S13 whether or not the operating portion 23 is operated. If it is determined that the operating portion 23 is operated (S13: YES), the printer 1 is controlled in S14 so as to operate in accordance with the operation performed on the operating portion 23.

If it is determined that the operating portion 23 is not operated (S13: NO), it is determined in S15 whether or not secure print data corresponding to the authentication ID exists, while referring to the secure print data stored in the secure printing data storing unit 39. If it is determined that secure print data corresponding to the authentication ID does not exist (S15: NO), the control returns to S4.

If it is determined that secure print data corresponding to the authentication ID exists (S15: YES), the secure print data are read in S16 from the secure printing data storing unit 39, and copied into the RAM 33. Then, the read secure print data are printed in S17. Thereafter, the CPU 31 returns to S4 to prepare for the next operation.

<Specific Example>

When the printer 1 is powered on, the printer 1 performs initialization (see S1 to S3 of FIG. 5). At this time, the printer 1 switches the signals from the first to fourth antennas 22*a*, 22*b*, 22*c*, 22*d*, controls the RFID reader/writer circuit 41 so as to individually receive the signals from the non-contact IC tags 21K, 21C, 21M, 21Y via the first to fourth antennas 22*a*, 22*b*, 22*c*, 22*d*, and stores the read data into the cartridge data storing unit 37 (see S201 to S216 of FIG. 6). Based on the data stored in the cartridge data storing unit 37, it is checked whether or not the image forming cartridges 19K, 19C, 19M, 19Y are correctly attached (see S301 to S305 of FIG. 7). If it is checked that the cartridges are correctly attached, the control enters a waiting state (in FIG. 5: S4: NO, S6: NO, S10, and S11: NO).

The authentication ID of a user who is authorized to operate the printer 1 is previously stored in the registered ID storing unit 38. When the authorized user holds the authentication card 28 over the printer 1, the authentication ID matches the registered ID, and hence the printer 1 activates the operating portion 23. When the user then inputs set values into the operating portion 23, for example, the printer 1 changes the predetermined values to the input values (in FIG. 5: S4: NO, S6: NO, S10, S11: YES, S12: YES, S13: YES, and S14).

Even when a user who is not authorized holds the authentication card 28 over the printer 1, the authentication ID does not match the registered ID, and hence the printer 1 does not activate the operating portion 23. Therefore, the user who is not authorized cannot freely operate the printer 1 (in FIG. 5: S4: NO, S6: NO, S10, S11: YES, and S12: NO).

In the case where the user transmits print data from the personal computer 26 to the printer 1, when the print data are not set as a secure print job, the printer 1 immediately performs the printing operation (in FIG. 5: S4: NO, S6: YES, S7: NO, and S8).

By contrast, in the case where the user holds the authentication card 28 over the reader/writer device 27 to cause the authentication ID to be read into the personal computer 26, and print data are set as a secure print job and transmitted from the personal computer 26 to the printer 1, the printer 1 does not execute printing, and stores the secure print data received from the personal computer 26, into the secure printing data storing unit 39 (in FIG. 5: S4: NO, S6: YES, S7: YES, and S9).

When the user moves to the printer 1 and holds the authentication card 28 over the printer 1 (particularly the vicinity of the first antenna 22*a*), the printer 1 reads the authentication ID from the non-contact IC tag 29 of the authentication card 28 via the first antenna 22*a*. If the printer 1 confirms that the authentication ID matches the registered ID and the user is authorized, the printer 1 prints the secure print data corresponding to the read authentication ID (in FIG. 5: S4: NO, S6: NO, S10, S11: YES, S12: YES, S13: NO, S15, YES, S16, and S17).

For example, in the case where the user see the display of the displaying portion 24 and detects that the toner remaining amount of the image forming cartridge 19Y becomes few, the user opens and closes the cover portion 4 in order to replace the cartridge (in FIG. 5: S4: YES and S5: YES).

In the printer 1, when the opening/closing of the cover portion 4 is detected, the communicating device 40 individually switches the first to fourth antennas 22*a*, 22*b*, 22*c*, 22*d*, and individually reads data from the non-contact IC tags 21K, 21C, 21M, 21Y of the image forming cartridges 19K, 19C, 19M, 19Y. Based on the read data, the printer 1 checks whether or not the image forming cartridges 19K, 19C, 19M, 19Y are correctly attached. If the image forming cartridges 19K, 19C, 19M, 19Y are correctly attached, it is rechecked that the cover portion 4 is closed, and then the control proceeds to the printing process (in FIG. 5: S2, S3, S4: NO, and S6).

In the printer 1, however, the attachment structures respectively for the image forming cartridges 19K, 19C, 19M, 19Y are identical to one another. Therefore, for example, there may occur a case that the image forming cartridge 19K for black (K) is erroneously attached to the attachment position for the image forming cartridge 19Y.

In this case, in the cartridge data storing unit 37, the data which are stored while associated with the fourth antenna 22*d* include the color data of black (K). By contrast, the color data which are to be originally read via the fourth antenna 22*d* indicate yellow (Y). Therefore, the color data (black) which are stored in the cartridge data storing unit 37 do not coincide with the color data (yellow) which are to be read via the fourth antenna 22*d*, and hence the printer 1 determines that the image forming cartridge 19K is not correctly attached to the body 2 (see S301 of FIG. 7: NO).

The printer 1 controls the displaying portion 24 so as to display an error message indicating that the image forming cartridge 19K attached to the rearmost attachment position is to be replaced with the image forming cartridge 19Y for yellow (Y). In this case, the printer 1 may control the displaying portion 24 so as to display the layout of the image forming cartridges 19K, 19C, 19M, 19Y so that the user easily understands the position of the erroneous attachment (see S302 of FIG. 7).

The user opens the cover portion 4, detaches the erroneously attached image forming cartridge 19K from the body 2, again attaches the image forming cartridge 19Y for yellow (Y) to the body 2, and thereafter closes the cover portion 4. Then, the printer 1 cancels the error messages displayed on the displaying portion 24 (in FIG. 7: S303: YES, S304: YES, and S305).

Thereafter, the printer 1 again switches the signals from the first to fourth antennas 22*a*, 22*b*, 22*c*, 22*d*, and individually receives the data from the image forming cartridges 19K, 19C, 19M, 19Y. At this time, the color data (yellow) included in the data received via the fourth antenna 22*d* coincide with the color data (yellow) which are to be read via the fourth antenna 22*d*. Therefore, the printer 1 determines that the image forming cartridges 19K, 19C, 19M, 19Y are correctly attached, and proceeds to the printing operation or the waiting state (in FIG. 5: S2, S3, and S4: NO).

Function and Effect of the Exemplary Embodiment

As described above, based on the positions of the first to fourth antennas 22*a*, 22*b*, 22*c*, or 22*d* from which data are received, the printer 1 of the first exemplary embodiment is capable of determining which one of the image forming cartridge 19K, 19C, 19M, or 19Y the received data relate to (see S2 and S3 of FIG. 5).

Consequently, the printer 1 of the first exemplary embodiment is capable of determining whether or not the image forming cartridges 19K, 19C, 19M, 19Y are correctly attached to the body 2, on the basis of the data stored in the cartridge data storing unit 37 while associated with the first to fourth antennas 22*a*, 22*b*, 22*c*, 22*d*.

Furthermore, the printer 1 of the first exemplary embodiment is configured such that the four antennas 22*a*, 22*b*, 22*c*, 22*d*, which are less expensive than the communicating device 40 (the RFID reader/writer circuit 41), are connected to the single communicating device 40 (the RFID reader/writer circuit 41). In the printer 1 of the first exemplary embodiment, therefore, the communicating device can be made less expensive than a configuration in which the communicating device 40 (the RFID reader/writer circuit 41) is provided for each of the first to fourth antennas 22*a*, 22*b*, 22*c*, 22*d*.

The thus configured printer 1 of the first exemplary embodiment is capable of determining that, at replacement of a cartridge, for example, the image forming cartridge 19K for black (K) is erroneously attached to the attachment position for the image forming cartridge 19Y for yellow (Y). Then, the printer 1 is capable of informing the user of the erroneous attachment of the image forming cartridge 19K, while specifying the erroneous attachment position (see S3 of FIG. 5, and S301 of FIG. 7: NO, and S302). According to the printer 1 of the first exemplary embodiment, therefore, printing is not performed while the image forming cartridge 19K for black (K) remains to be erroneously attached to the position to which the image forming cartridge 19Y for yellow (Y) is to be attached, and hence an excellent printed result can be obtained.

In the printer 1 of the first exemplary embodiment, the image forming cartridges 19K, 19C, 19M, 19Y are aligned inside the body 2, and the first to fourth antennas 22*a*, 22*b*, 22*c*, 22*d* are placed inside the upper portion 2*a* of the resin-made body 2 which covers the image forming cartridges 19K, 19C, 19M, 19Y. Therefore, the first to fourth antennas 22*a*, 22*b*, 22*c*, 22*d* is capable of communicating with the external non-contact IC tag 29 through the upper portion 2*a* of the resin-made body 2 (see FIG. 2). Consequently, in the printer 1 of the first exemplary embodiment, for example, the first antenna 22*a* is capable of being used for reading data from the non-contact IC tag 21K attached to the image forming cartridge 19K, and for reading the authentication ID or the like from the non-contact IC tag 29 of an employee ID card, the authentication card 28, or the like.

In the printer 1 of the first exemplary embodiment, the image forming cartridges 19K, 19C, 19M, 19Y are placed in the anteroposterior direction (the direction from the −X side to the +X side) of the body 2, and the plane area of the foremost first antenna 22*a* is larger than the plane areas of the other or second to fourth antennas 22*b*, 22*c*, 22*d*, so that the data reading region of the first antenna is made larger. The first antenna 22*a* which is at the foremost position is positioned to be closest to the user. Therefore, the user can easily hold the authentication card 28 or the like over the first antenna 22*a* which is placed at the foremost position (see FIGS. 2 and 3). Consequently, the printer 1 of the first exemplary embodiment is convenient to use since the user can easily cause data stored in the non-contact IC tag 29 such as the authentication card 28 to be read via the foremost first antenna 22*a*.

In the printer 1 of the first exemplary embodiment, if the cover portion 4 is closed after the cover portion 4 is opened and the image forming cartridges 19K, 19C, 19M, 19Y are exposed to the outside of the body portion 3, the first to fourth antennas 22*a*, 22*b*, 22*c*, 22*d* are individually switched (in FIG. 5: S4: YES, S5: YES, and S2). According to the printer 1 of the first exemplary embodiment, if the cover portion 4 is opened and closed, and it is conceived that the image forming cartridges 19K, 19C, 19M, 19Y are replaced with new ones, therefore, the first to fourth antennas 22*a*, 22*b*, 22*c*, 22*d* are individually switched, and it is possible to check whether or not the image forming cartridges 19K, 19C, 19M, 19Y are correctly attached to the body 2, on the basis of data read from the non-contact IC tags 21K, 21C, 21M, 21Y.

In the printer 1 of the first exemplary embodiment, the first to fourth antennas 22*a*, 22*b*, 22*c*, 22*d* are placed on the cover portion 4 which covers the opening 3*a* configured to be opened upwardly with respect to the body portion 3. Therefore, if the cover portion 4 is opened for cartridge replacement, the first to fourth antennas 22*a*, 22*b*, 22*c*, 22*d* are removed away together with the cover portion 4 from the upper side of the image forming cartridges 19K, 19C, 19M, 19Y. Consequently, according to the printer 1 of the first exemplary embodiment, the first to fourth antennas 22*a*, 22*b*, 22*c*, 22*d* which are placed above the image forming cartridges 19K, 19C, 19M, 19Y do not interfere with the cartridge replacement work.

In the printer 1 of the first exemplary embodiment, the discharge tray 6, to which the sheet 10 formed thereon an image by using the toners of black (K), cyan (C), magenta (M), and yellow (Y) housed in the image forming cartridges 19K, 19C, 19M, 19Y is to be discharged, is formed on the upper portion 2*a* of the body 2, and the first to fourth antennas 22*a*, 22*b*, 22*c*, 22*d* are placed on the lower side (back side) of the discharge tray 6. Usually, in the discharge tray 6, a space which is necessary for taking out discharged sheets 10 is ensured. Consequently, according to the printer 1 of the first exemplary embodiment, for example, the first antenna 22*a* can easily read data not only from the non-contact IC tag 21K mounted on the image forming cartridge 19K, but also from the non-contact IC tag 29 mounted on the authentication card 28.

Particularly, in the case where the inventive concept of the present invention is applied to a multifunction apparatus, an image reading unit is disposed on the upper face of the body 2. In the discharge tray 6, a space which is necessary for taking out discharged sheets 10 is ensured. Therefore, both the body 2 of the printer 1, and that of a multifunction apparatus can be similarly designed. In association with this, the printer 1 of the first exemplary embodiment has advantages in which parts are made common to a printer and a multifunction apparatus, the time for design can be shortened, and the cost can be reduced.

Second Exemplary Embodiment

Figure 8:
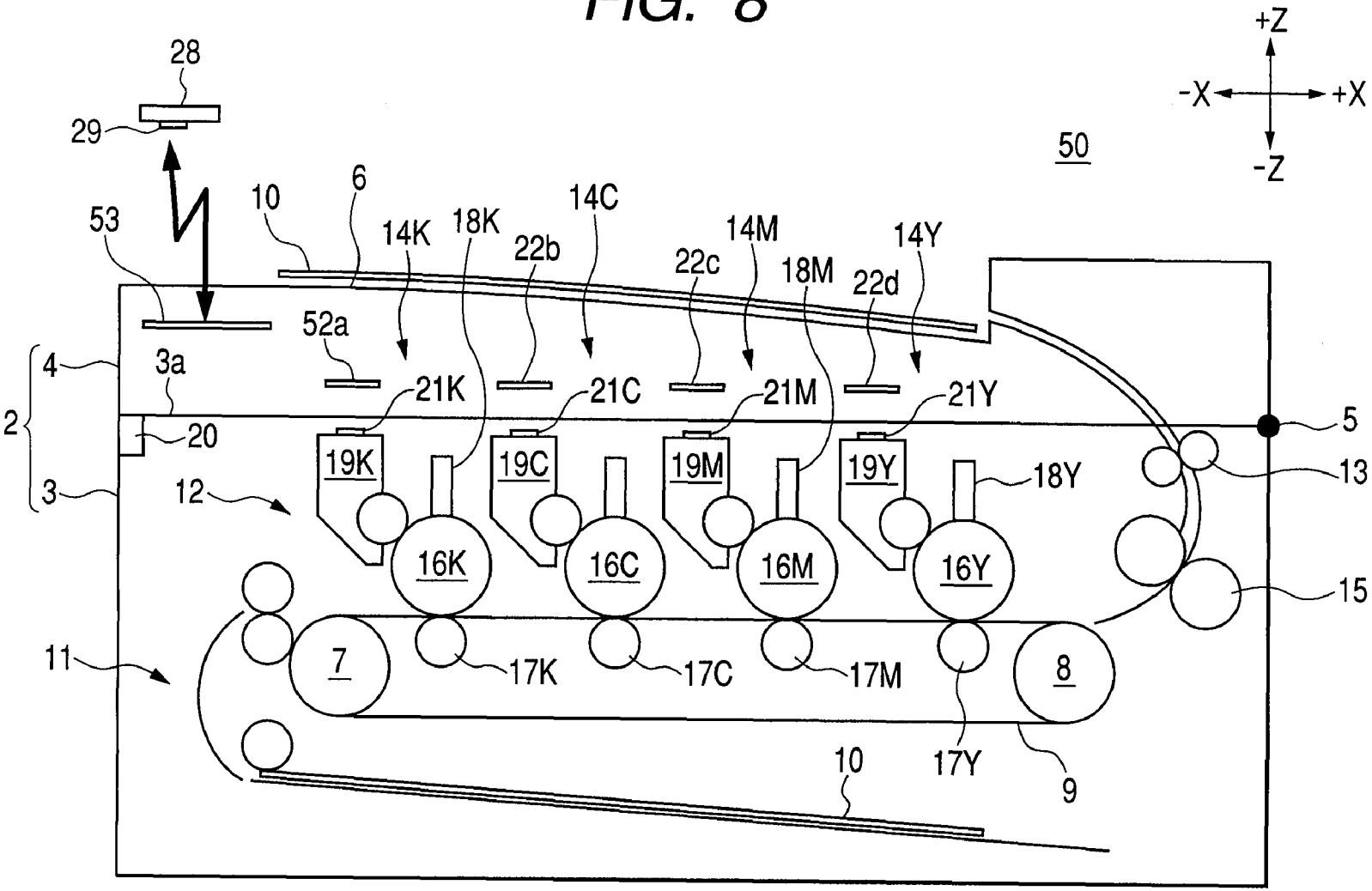
FIG. 8 is a schematic diagram of the internal configuration of an image forming apparatus (printer) of a second exemplary embodiment of the present invention.
Figure 9:
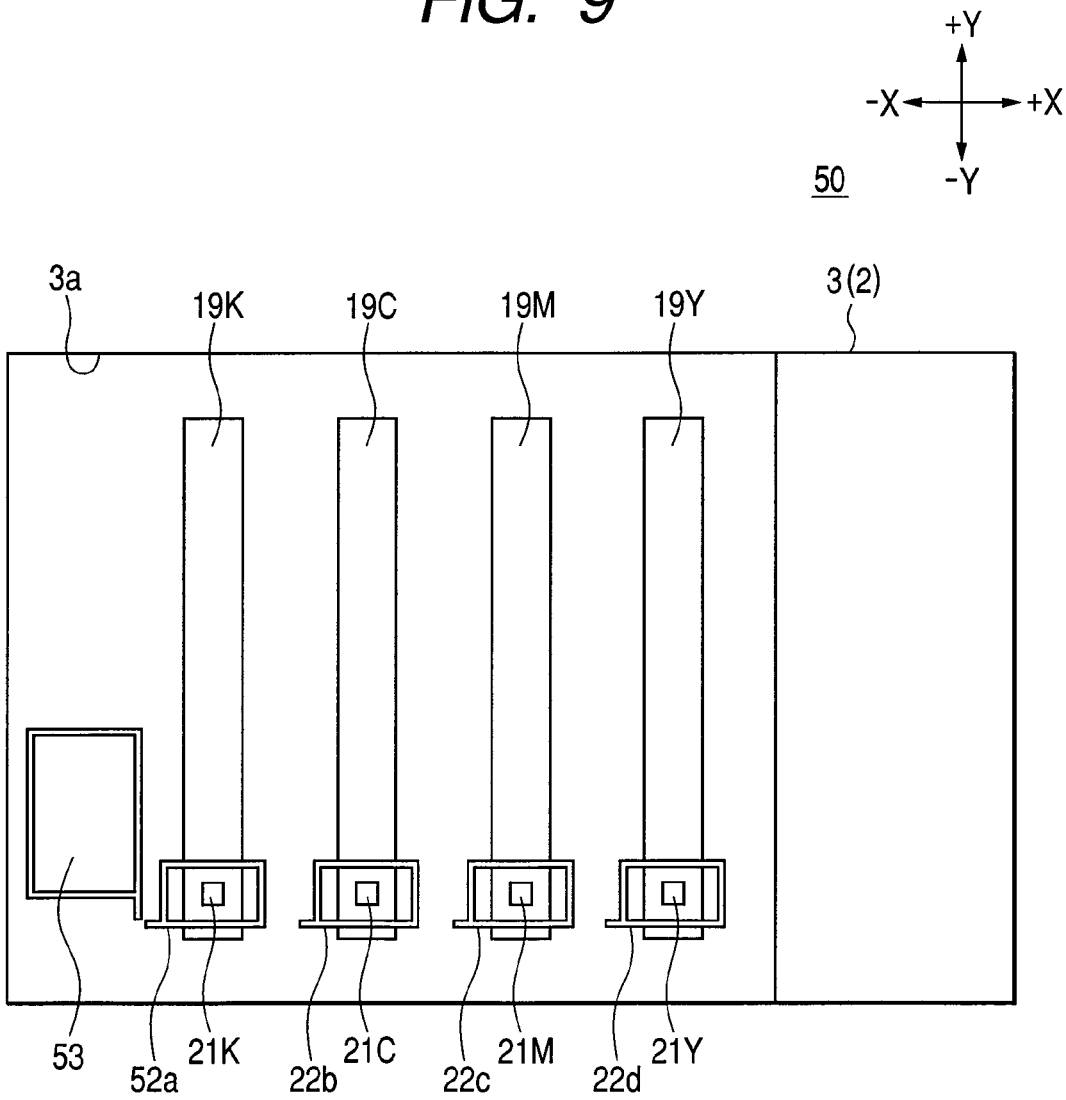
FIG. 9 is a diagram of the printer shown in FIG. 8 as viewed from the upper side, and showing positional relationships among non-contact IC tags and antennas.

Next, an image forming apparatus of a second exemplary embodiment of the present invention will be described with reference to the drawings. FIG. 8 is a schematic diagram of the internal configuration of a printer 50 as an exampled of the image forming apparatus of the second exemplary embodiment. FIG. 9 is a diagram of the printer 50 shown in FIG. 8 as viewed from the upper side, and showing positional relationships among the non-contact IC tags 21K, 21C, 21M, 21Y and second to sixth antennas 22*b*, 22*c*, 22*d*, 52*a*, 53.

The printer 50 is different from the printer 1 of the first exemplary embodiment in which an antenna 53 for personal authentication is disposed separately from the antenna 52*a* for black (K). Therefore, the following description will be focused on points different from the first exemplary embodiment. The portions which are common to the first exemplary embodiment are denoted by the same reference numerals as the first exemplary embodiment, and their description will be suitably omitted.

In the printer 50, in addition to the second to fourth antennas 22*b*, 22*c*, 22*d*, fifth and sixth antennas 52*a*, 53 are placed inside the upper portion 2*a* of the body 2, i.e., inside (back side) the cover portion 4 or the discharge tray 6.

The fifth antenna 52*a* is placed correspondingly with the non-contact IC tag 21K of the image forming cartridge 19K, and dedicated for reading the non-contact IC tag 21K. The fifth antenna 52*a* is equal in plane area to the second to fourth antennas 22*b*, 22*c*, 22*d*.

The sixth antenna 53 is placed at the foremost portion of the upper portion 2*a* (the cover portion 4 or the discharge tray 6) of the body 2. The plane area of the sixth antenna 53 is set to be larger than the plane areas of the second to fifth antennas 22*b*, 22*c*, 22*d*, 52*a*. In the second exemplary embodiment, the plane area of the sixth antenna 53 is set to be larger than that of the authentication card 28.

In the thus configured printer 50, the fifth antenna 52*a* communicates with the non-contact IC tag 21K attached to the image forming cartridge 19K for black (K). The sixth antenna 53 reads the authentication ID from the non-contact IC tag 29 of the authentication card 28. In the printer 50, namely, the fifth antenna 52*a* which reads data from the non-contact IC tag 21K of the image forming cartridge 19K is disposed separately from the sixth antenna 53 which reads the authentication ID from the non-contact IC tag 29 of the authentication card 28.

The printer 50 switches the signals from the second to sixth antennas 22*b*, 22*c*, 22*d*, 52*a*, 53.

Therefore, according to the printer 50 of the second exemplary embodiment, in addition of the effects of the first exemplary embodiment, the sixth antenna 53 can be placed at a position over which the authentication card 28 can be easily held, irrespective of the placement of the non-contact IC tag 21K. Although the cost of the printer 50 of the second exemplary embodiment may become higher than that of the printer 1 of the first exemplary embodiment since the number of antennas is increased, the cost is lower than that of the case where communicating devices 40 (reader/writer devices 42) are connected to antennas, respectively.

Third Exemplary Embodiment

Figure 10:
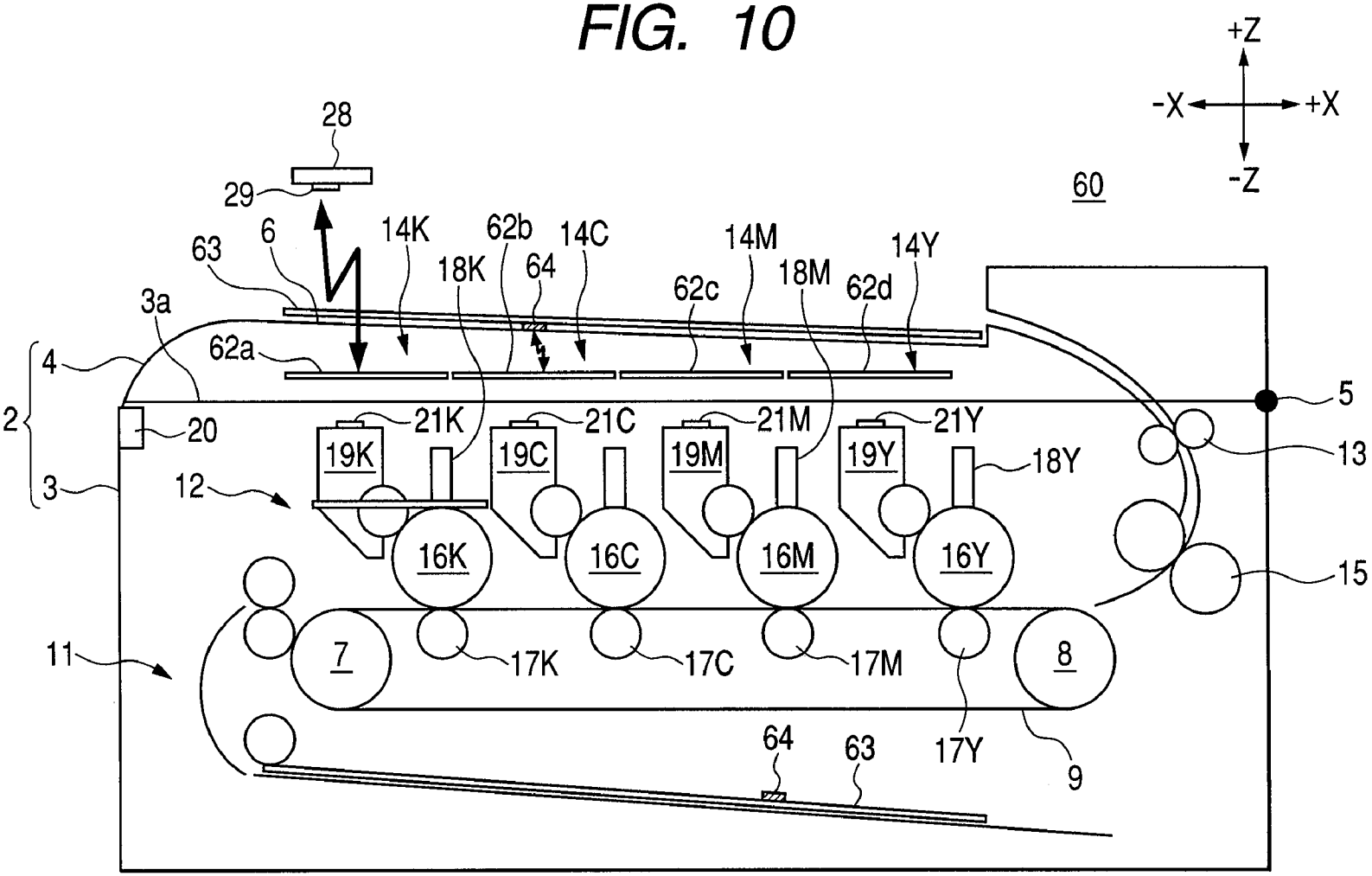
FIG. 10 is a schematic diagram of the internal configuration of an image forming apparatus (printer) of a third exemplary embodiment of the present invention.
Figure 11:
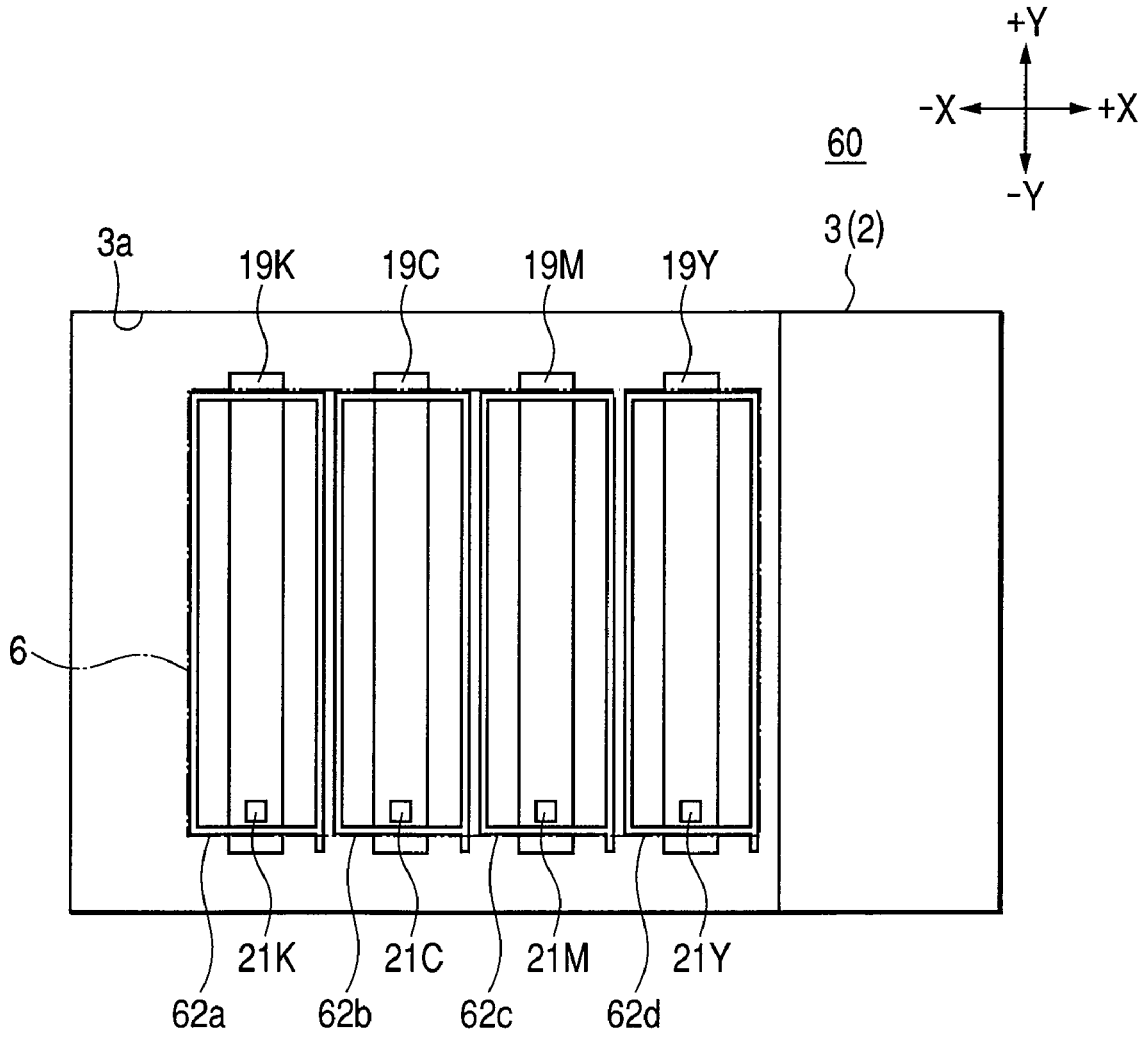
FIG. 11 is a diagram of the printer shown in FIG. 10 as viewed from the upper side, and showing positional relationships among non-contact IC tags and antennas.

Next, an image forming apparatus of a third exemplary embodiment of the present invention will be described with reference to the drawings. FIG. 10 is a schematic diagram of the internal configuration of a printer 60 as an example of the image forming apparatus of the third exemplary embodiment. FIG. 11 is a diagram of the printer 60 shown in FIG. 10 as viewed from the upper side, and showing positional relationships among the non-contact IC tags 21K, 21C, 21M, 21Y and seventh to tenth antennas 62*a*, 62*b*, 62*c*, 62*d*.

The printer 60 is different from the printer 1 of the first exemplary embodiment in that the seventh to tenth antennas 62*a*, 62*b*, 62*c*, 62*d* are placed over the whole region of the discharge tray 6. The following description will be focused on points different from the first exemplary embodiment. The portions which are common to the first exemplary embodiment are denoted by the same reference numerals as the first exemplary embodiment, and their description will be suitably omitted.

In the printer 60 of the third exemplary embodiment, as shown in FIGS. 10 and 11, the seventh to tenth antennas 62*a*, 62*b*, 62*c*, 62*d* have the same shape. The seventh to tenth antennas 62*a*, 62*b*, 62*c*, 62*d* are laid inside the upper portion 2*a* (inside the cover portion 4 or the discharge tray 6) of the body 2. In the seventh to tenth antennas 62*a*, 62*b*, 62*c*, 62*d*, as shown in FIG. 11, the dimensions in the width direction (±Y direction) and the depth direction (±X direction) are defined so that the antennas cover the whole region of the back side of the discharge tray 6.

The thus configured printer 60 switches the signals from the seventh to tenth antennas 62*a*, 62*b*, 62*c*, 62*d*.

During the printing process, the printer 60 transmits a response request signal to the outside via the resin-made body 2 (the cover portion 4 and the discharge tray 6) from the seventh to tenth antennas 62*a*, 62*b*, 62*c*, 62*d*. Therefore, for example, in the case where an image is to be formed on a sheet 63 to which a non-contact IC tag 64 is attached, the non-contact IC tag 64 of the sheet 63 transmits a response signal in response to the response request signal from any one of the seventh to tenth antennas 62*a*, 62*b*, 62*c*, 62*d*. The response signal is sent to any one of the seventh to tenth antennas 62*a*, 62*b*, 62*c*, 62*d*.

Moreover, in the printer 60, a response request signal which requests for a response can be sent from, for example, the seventh antenna 62*a* to the non-contact IC tag 29 of the authentication card 28. In this case, when the user holds the authentication card 28 over the discharge tray 6 of the printer 1, the printer is capable of reading the authentication ID from the non-contact IC tag 29 of the authentication card 28.

Therefore, according to the printer 60 of the third exemplary embodiment, in addition of the effects of the first exemplary embodiment, the seventh to tenth antennas 62*a*, 62*b*, 62*c*, 62*d* can be used in both applications for reading data from the non-contact IC tags 21K, 21C, 21, 21Y attached to the image forming cartridges 19K, 19C, 19M, 19Y, and for reading data from the non-contact IC tag 64 included in the sheet 63.

In this case, since the seventh to tenth antennas 62*a*, 62*b*, 62*c*, 62*d* are disposed correspondingly with the image forming cartridges 19K, 19C, 19M, 19Y, it can be determined which one of the seventh to tenth antennas 62*a*, 62*b*, 62*c*, 62*d* receives the response signal from the non-contact IC tag 64 of the sheet 63, whereby the position in the sheet 63 where the non-contact IC tag 64 is placed can be determined. In the case where the eighth antenna 62*b* receives data from the non-contact IC tag 64 of the sheet 63, for example, only the eighth antenna 62*b* may output the response request signal to the non-contact IC tag 64 of the sheet 63. According to the configuration, the power consumption can be reduced as compared with the case where all of the seventh to tenth antennas 62*a*, 62*b*, 62*c*, 62*d* output the response request signal.

When the printer 60 is configured so that the seventh antenna 62*a* which is placed at the foremost portion of the body 2 reads data from the non-contact IC tag 29 of the authentication card 28, the seventh antenna 62*a* can be used also in an application of personal authentication. Particularly, the seventh antenna 62*a* is disposed in the whole region in the width direction (±Y direction) of the discharge tray 6, and hence the area over which the user can hold the authentication card 28 becomes large. Therefore, this configuration is convenient to use. It is a matter of course that the authentication card 28 may be read by the eighth to tenth antennas 62*b*, 62*c*, 62*d*.

Fourth Exemplary Embodiment

Figure 12:
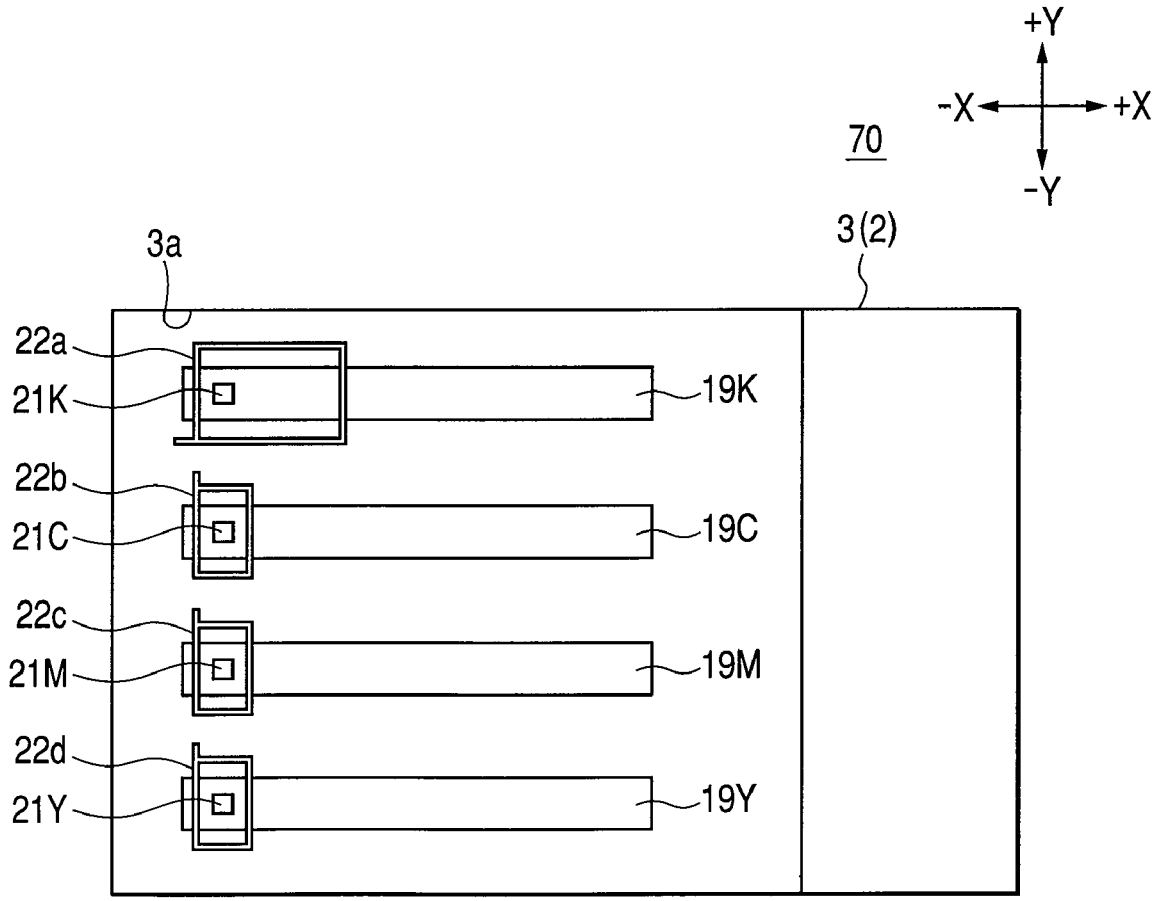
FIG. 12 is a schematic diagram of the internal configuration of an image forming apparatus (printer) of a fourth exemplary embodiment of the present invention as viewed from the upper side.

Next, an image forming apparatus of a fourth exemplary embodiment of the present invention will be described with reference to the drawings. FIG. 12 is a schematic diagram of the internal configuration of a printer 7 as an example of the image forming apparatus of the fourth exemplary embodiment as viewed from the upper side.

The printer 70 is different from the printer 1 of the first exemplary embodiment in that the first to fourth antennas 22*a*, 22*b*, 22*c*, 22*d* are aligned in the lateral direction (±Y direction) of the body 2. Therefore, the following description will be focused on points different from the first exemplary embodiment. The portions which are common to the first exemplary embodiment are denoted by the same reference numerals as the first exemplary embodiment, and their description will be suitably omitted.

In the printer 70, the image forming cartridges 19K, 19C, 19M, 19Y are aligned inside the body 2 in the horizontal lateral direction (±Y direction in the figure) perpendicular to the horizontal anteroposterior direction (±X direction in the figure). Inside the upper portion 2*a* of the body 2 (inside the cover portion 4 or the discharge tray 6), the first to fourth antennas 22*a*, 22*b*, 22*c*, 22*d* are aligned correspondingly with the image forming cartridges 19K, 19C, 19M, 19Y, in the lateral direction (±Y direction).

On the image forming cartridges 19K, 19C, 19M, 19Y, the non-contact IC tags 21K, 21C, 21M, 21Y are attached to a foremost portion of the upper face. Correspondingly with the tags, the first to fourth antennas 22*a*, 22*b*, 22*c*, 22*d* are placed in a foremost portion of the upper portion 2*a* (the cover portion 4 or the discharge tray 6) of the body 2.

In the fourth exemplary embodiment, the plane area of the foremost first antenna 22*a* is larger than the plane areas of the other or second to fourth antennas 22*b*, 22*c*, 22*d*. Alternatively, for example, the plane area of any one of the second to fourth antennas 22*b*, 22*c*, 22*d* may be made larger.

In the printer 70, the first to fourth antennas 22*a*, 22*b*, 22*c*, 22*d* are individually switched. Moreover, in the printer 70, the first to fourth antennas 22*a*, 22*b*, 22*c*, 22*d* are used also in an application of obtaining the authentication ID.

The thus configured printer 70 of the fourth exemplary embodiment can attain the same effects as the printer 1 of the first exemplary embodiment.

Fifth Exemplary Embodiment

Figure 13:
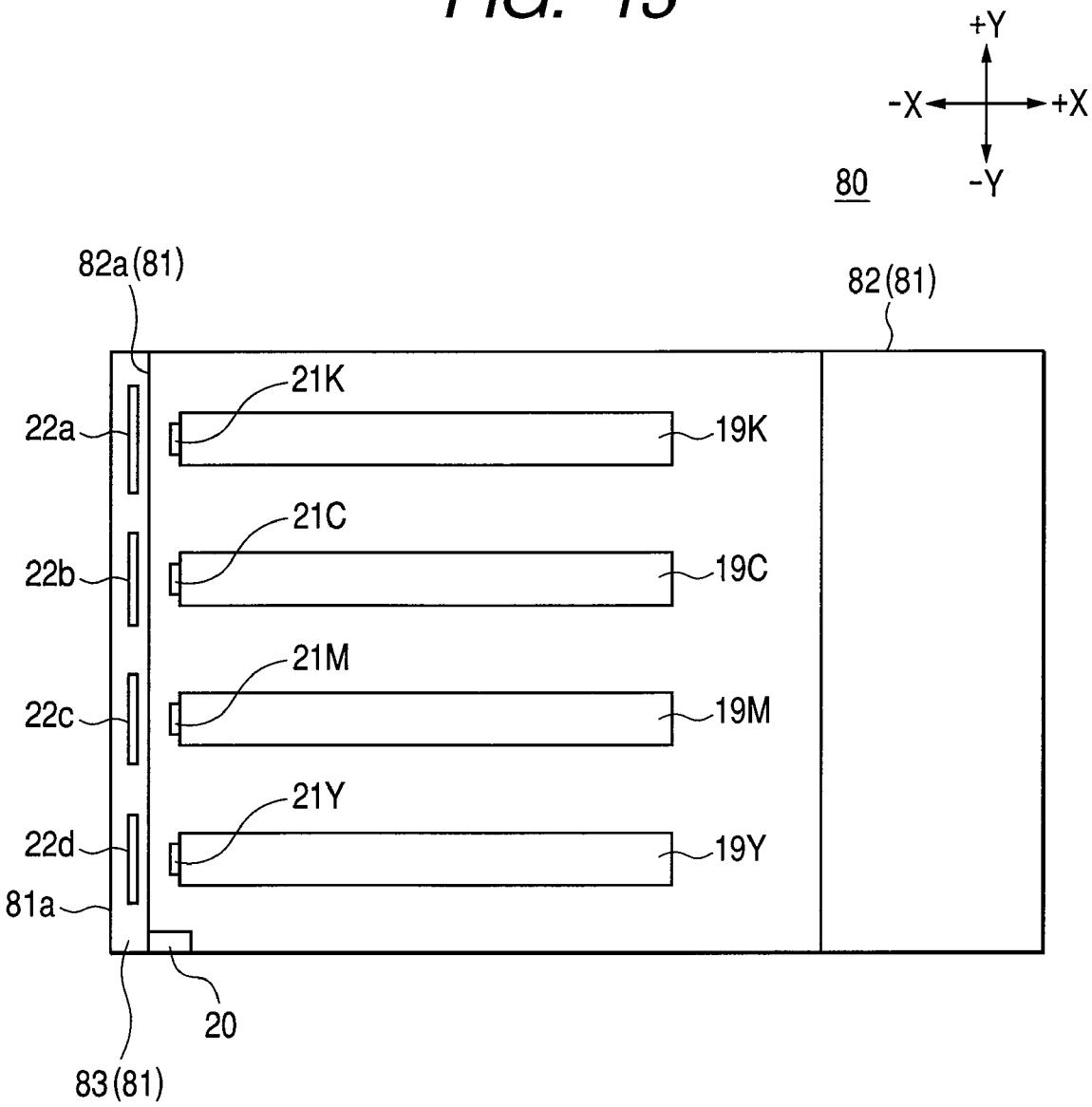
FIG. 13 is a schematic diagram of the internal configuration of an image forming apparatus (printer) of a fifth exemplary embodiment of the present invention as viewed from the upper side.

Next, an image forming apparatus of a fifth exemplary embodiment of the present invention will be described with reference to the drawings. FIG. 13 is a schematic diagram of the internal configuration of a printer 80 as an example of the image forming apparatus of the fifth exemplary embodiment as viewed from the upper side.

The printer 80 is different from the printer 70 of the fourth exemplary embodiment in that the first to fourth antennas 22*a*, 22*b*, 22*c*, 22*d* are placed inside a front portion 81*a* of the body 81. Therefore, the following description will be focused on points different from the fourth exemplary embodiment. The portions which are common to the fourth exemplary embodiment are denoted by the same reference numerals as the first exemplary embodiment, and their description will be suitably omitted.

The body 81 of the printer 80 has a body portion 82 which is configured by a resin molded product, and which comprises an opening 82*a* that is forwardly opened, and a cover portion 83 which covers the opening 82*a*. The cover portion 83 is pivotably held by the body portion 82. The body portion 82 and the cover portion 83 are resin molded products.

Inside a front portion 81*a* of the body 81, i.e., inside the cover portion 83, the first to fourth antennas 22*a*, 22*b*, 22*c*, 22*d* are placed corresponding with the image forming cartridges 19K, 19C, 19M, 19Y. Namely, the first to fourth antennas 22*a*, 22*b*, 22*c*, 22*d* are placed in the lateral direction (±Y direction) of the front portion 81*a* (the cover portion 83) of the body 81.

Therefore, in the printer 80 of the fifth exemplary embodiment, the first to fourth antennas 22*a*, 22*b*, 22*c*, 22*d* are capable of communicating with a non-contact IC tag outside the body, through the resin-made cover portion 83. Namely, for example, the first antenna 22*a* is capable of communicating with the non-contact IC tag 29 of the authentication card 28 which is held over the front portion 81 a of the printer 1, to obtain the authentication ID. Therefore, in the printer 80 of the fifth exemplary embodiment, in addition to the effects of the fourth exemplary embodiment, the first to fourth antennas 22*a*, 22*b*, 22*c*, 22*d* can be used for reading data from the non-contact IC tags 21K, 21C, 21M, 21Y attached to the image forming cartridges 19K, 19C, 19K 19Y, and for reading the authentication ID or the like from the non-contact IC tag 29 of an employee ID card, the authentication card 28, or the like.

In the printer 80 of the fifth exemplary embodiment, the first to fourth antennas 22*a*, 22*b*, 22*c*, 22*d* are placed on the cover portion 83 which covers the opening 82*a* that is opened forwardly with respect to the body portion 82. Therefore, when the cover portion 83 is opened for cartridge replacement, the first to fourth antennas 22*a*, 22*b*, 22*c*, 22*d* are moved away together with the cover portion 83 from the front side of the image forming cartridges 19K, 19C, 19M, 19Y. According to the printer 80 of the fifth exemplary embodiment, consequently, the first to fourth antennas 22*a*, 22*b*, 22*c*, 22*d* which are placed in front of the image forming cartridges 19K, 19C, 19M, 19Y do not interfere with the cartridge replacement work.

While the present invention has been shown and described with reference to certain exemplary embodiments thereof, it will be understood by those skilled in the art that various changes in form and details may be made therein without departing from the spirit and scope of the invention as defined by the appended claims.

In the exemplary embodiments, the printer 1 has been described as an example of the image forming apparatus. However, the inventive concept of the present invention may be also applied to an apparatus which performs printing, such as a multifunction apparatus, a copier, or a facsimile apparatus may used as the image forming apparatus. The developer is not limited to a toner, and may be an ink or the like.

What is claimed is:

1. An image forming apparatus comprising:

a body, to which a plurality of image forming cartridges containing developers are attachable, the body including:

a body portion including an opening though which the plurality of image forming cartridges are exposed to outside;

a cover portion which is coupled to the body portion and is capable of covering the opening; and an open/close detecting unit configured to detect open and close states of the cover portion; and a communication device configured to wirelessly communicate with a plurality of non-contact tags associated with the plurality of image forming cartridges, respectively, wherein the communication device includes:

a plurality of antennas which are provided correspondingly with the plurality of image forming cartridges; and a switching controller configured to switch between signals from the plurality of antennas, and wherein the communication device is configured such that one of the antennas is configured to wirelessly communicate with the non-contact tag of the corresponding one of the image forming cartridges and a non-contact tag associated with an external device, wherein the communication device includes a first mode of communicating with the plurality of non-contact tags associated with the plurality of image forming cartridges and a second mode of communicating with the non-contact tag associated with the external device, and wherein the communication device switches to the first mode at least when the image forming apparatus is powered on or when the open/close detecting unit detects a state change of the cover portion from the open state to the close state.

2. The image forming apparatus according to claim 1, wherein the plurality of image forming cartridges are aligned in the body in a horizontal direction, and wherein the plurality of antennas are disposed inside an upper portion of the body.

3. The image forming apparatus according to claim 1, wherein the plurality of image forming cartridges are aligned in a lateral direction perpendicular to an anteroposterior direction of the body, and wherein the plurality of antennas are disposed inside a front portion of the body.

4. The image forming apparatus according to claim 3, further comprising:

a conveying portion which conveys a sheet in a conveyance direction; and an image forming portion which forms an image on the conveyed sheet with the developers contained in the plurality of image forming cartridges, wherein the anteroposterior direction is along the conveyance direction.

5. The image forming apparatus according to claim 1, wherein the plurality of image forming cartridges are aligned in an anteroposterior direction of the body, and wherein a plane area of one of the plurality of antennas, which is provided correspondingly with one of the image forming cartridges located at front side among the plurality of image forming cartridges, is larger than a plane area of another antenna which is provided correspondingly with another image forming cartridge.

6. The image forming apparatus according to claim 5, further comprising:

a conveying portion which conveys a sheet in a conveyance direction; and an image forming portion which forms an image on the conveyed sheet with the developers contained in the plurality of image forming cartridges, wherein the anteroposterior direction is along the conveyance direction.

7. The image forming apparatus according to claim 2, wherein the body comprises:

a body portion including an opening which is opened upwardly; and a cover portion which covers the opening, and wherein the plurality of antennas are provided in the cover portion.

8. The image forming apparatus according to claim 3, wherein the body comprises:

a body portion including an opening which is opened forwardly; and a cover portion which covers the opening, and wherein the plurality of antennas are provided in the cover portion.

9. The image forming apparatus according to claim 2, wherein the body comprises a discharge tray which is formed on the upper portion and to which a sheet on which an image is formed with the developers contained in the plurality of image forming cartridges is to be discharged.

10. The image forming apparatus according to claim 9, wherein the plurality of antennas are provided over a whole region of the discharge tray.

11. An image forming apparatus comprising:

a body including a receiving portion configured to receive a plurality of cartridges containing developers, the body having an opening though which the plurality of cartridges are attached to receiving unit;

a cover which is coupled to the body and takes an open state in which the cartridges are attachable to the receiving unit through the opening and a close state in which the opening is covered;

a detecting unit configured to detect a state of the cover;

an image forming portion configured to form an image on a sheet with the developers of the plurality of cartridges;

a plurality of antennas provided for the plurality of cartridges and configured to receive data from a plurality of non-contact tags attached to the plurality of cartridges, respectively;

a selecting switch which selects one of the plurality of antennas; and a tag reader which reads data from the selected one of the plurality of antennas, wherein one of the antennas is configured to wirelessly communicate with the non-contact tag of the corresponding one of the cartridges and a non-contact tag associated with an external device, wherein the image forming apparatus includes a first mode of communicating with the plurality of non-contact tags associated with the plurality of cartridges and a second mode of communicating with the non-contact tag associated with the external device, and wherein the image forming apparatus switches to the first mode at least when the image forming apparatus is powered on or when the detecting unit detects that a state of the cover changes from the open state to the close state.

12. The image forming apparatus according to claim 11, further comprising a storing unit which stores the data read from the tag reader while associated with information indicating the antenna from which the data is read.

13. The image forming apparatus according to claim 12, wherein each of the non-contact tags stores color data indicating a color of the developer contained in the corresponding one of the cartridges.

14. The image forming apparatus according to claim 13, further comprising a determining unit which determines whether the plurality of cartridges are received correctly by the receiving portion based on data stored in the storing unit.

15. The image forming apparatus according to claim 11, wherein the selecting switch selects, in order, the plurality of antennas when the image forming apparatus is turned on.

16. The image forming apparatus according to claim 1, wherein the plurality of antennas includes first, second, third, and fourth antennas, wherein the first antenna is configured to wirelessly communicate with the non-contact tag of the corresponding one of the image forming cartridges and the non-contact tag associated with the external device, and wherein the switching controller switches signals from the fourth, third, second, and first antennas in this order.

17. The image forming apparatus according to claim 12, wherein the plurality of antennas include first, second, third and fourth antennas, wherein the first antenna is configured to wirelessly communicate with the non-contact tag of the corresponding one of the cartridges and the non-contact tag associated with the external device, and wherein the selecting switch selects the fourth, third, second and first antennas in this order.

18. The image forming apparatus according to claim 5, wherein the antenna that corresponds with one of the image forming cartridges located at the front side among the plurality of image forming cartridges is larger than the another of the antennas and is configured to wirelessly communicate with the non-contact tag of the corresponding one of the image forming cartridges and the non-contact tag associated with the external device.

19. The image forming apparatus according to claim 1, wherein the external device is an identification card.

20. The image forming apparatus according to claim 11, wherein the external device is an identification card.

21. An image forming apparatus comprising:

a body including:

a body portion including an opening;

a cover portion which is coupled to the body portion and is capable of covering the opening; and an open/close detecting unit detects a state change of cover portion from the open state to the close state.

a first image forming cartridge comprising a first non-contact tag;

a second image forming cartridge comprising a second non-contact tag;

a communication device configured to communicate wirelessly with the first and second non-contact tags;

a first antenna;

a second antenna; and a switching controller configured to couple the first antenna and the second antenna exclusively to the communication device, wherein the communication device includes a first mode and a second mode;

wherein, in the first mode, the switching controller couples the first antenna to the communication device and the communication device communicates with the first non-contact tag via the first antenna, and the switching controller couples the second antenna to the communication device and the communication device communicates with the second non-contact tag via the second antenna, and wherein, in the second mode, the switching controller couples the first antenna to the communication device and the communication device communicates with a non-contact tag provided on an external device via the first antenna, and wherein the communication device switches to the first mode when the image forming apparatus is turned on or when the open/close detecting unit detects a state change of the cover portion from the open state to the close state.

* * * * *